US008864258B2

(12) United States Patent
Fukuda

(10) Patent No.: US 8,864,258 B2
(45) Date of Patent: Oct. 21, 2014

(54) LIQUID EJECTING APPARATUS AND CONTROL METHOD THEREOF

(75) Inventor: Masako Fukuda, Shiojiri (JP)

(73) Assignee: Seiko Epson Corporation (JP)

( * ) Notice: Subject to any disclaimer, the term of this patent is extended or adjusted under 35 U.S.C. 154(b) by 149 days.

(21) Appl. No.: 13/361,030

(22) Filed: Jan. 30, 2012

(65) Prior Publication Data

US 2012/0194585 A1 Aug. 2, 2012

(30) Foreign Application Priority Data

Jan. 31, 2011 (JP) ..... 2011-017634

(51) Int. Cl.
*B41J 29/38* (2006.01)
*B41J 2/165* (2006.01)

(52) U.S. Cl.
CPC ..... *B41J 29/38* (2013.01); *B41J 2/16526* (2013.01)
USPC ..... 347/9; 347/35

(58) Field of Classification Search
USPC ..... 347/9, 35
See application file for complete search history.

(56) References Cited

U.S. PATENT DOCUMENTS 5,541,628 A * 7/1996 Chang et al. ..... 347/10
6,139,125 A * 10/2000 Otsuka et al. ..... 347/11
6,488,354 B2 12/2002 Hosono
2001/0050696 A1* 12/2001 Suzuki et al. ..... 347/27
2002/0005873 A1 1/2002 Suzuki
2002/0144550 A1* 10/2002 Nishihara ..... 73/651
2007/0076025 A1 4/2007 Nagashima

FOREIGN PATENT DOCUMENTS

JP 2000-117993 4/2000
JP 2001-270134 10/2001
JP 2002-273912 A 9/2002
JP 2003-001857 1/2003
JP 2003-080702 3/2003
JP 2007-098652 A 4/2007
JP 2007-230243 9/2007
JP 2007-268743 A 10/2007
JP 2008-023963 2/2008
JP 2008-213330 9/2008

* cited by examiner

*Primary Examiner* — Manish S Shah
*Assistant Examiner* — Yaovi Ameh
(74) *Attorney, Agent, or Firm* — Harness, Dickey & Pierce, P.L.C.

(57) ABSTRACT

A recording head that includes a pressure chamber filled with ink and a piezoelectric element changing pressure inside the pressure chamber, and that ejects ink from the nozzle according to the change in the pressure inside the pressure chamber. A control unit controls the piezoelectric element and performs ejection driving for ejecting the ink from the nozzle or micro-vibration driving for micro-vibrating a liquid surface inside the nozzle to an extent at which the ink is not ejected from the nozzle; and performs a flushing operation of an ejection amount according to a number of times of micro-vibration driving in a driving period, in a preparation period after the driving period has passed.

8 Claims, 8 Drawing Sheets

| Nt | Nb | AFL |
|---|---|---|
| MANY | FEW | AFL1 [FEW] |
| 0 | 0 | AFL0 [FEWEST] |
| MEDIUM | MEDIUM | AFL2 [MEDIUM] |
| 0 | 0 | AFL0 [FEWEST] |
| FEW | MANY | AFL3 [MANY] |

:EJECTION

:MICRO-VIBRATION

:STANDBY

LIQUID EJECTING APPARATUS AND CONTROL METHOD THEREOF

BACKGROUND

1. Technical Field

The present invention relates to a technique for ejecting liquid such as ink.

2. Related Art

A liquid ejecting technique for ejecting liquid (for example, ink) of a pressure chamber from a nozzle by changing the pressure of a pressure chamber using a pressure generating element such as a piezoelectric element or a heating element has previously been proposed. An ink jet type recording head employing such a technique is provided with a plurality of pressure chambers communicating with a nozzle, a reservoir which is a common liquid chamber communicating with each pressure chamber, and a pressure generating unit that changes the pressure of a pressure chamber and thereby ejecting liquid from a nozzle. As the pressure generating unit, for example, an axial vibration type piezoelectric element, a flexible vibration type piezoelectric element, an element using electrostatic force, a heating element, and the like are employed.

In ink jet type recording heads, ink in the nozzles which is not used for printing for a long time is thickened and there are problems in that the ejecting amount is reduced at the time of the next ejection and in that the thickened component of the ink (below referred to as "thickened component") becomes clogged in the nozzle. Here, a configuration is employed in which a flushing operation of ejecting the thickened component from the nozzle is performed periodically (for example, JP-A-2000-117993 and JP-A-2003-001857).

In addition, in the ink jet type recording head, micro-vibration driving is performed to micro-vibrate the free surface (meniscus) of the ink exposed to the inside of the nozzle to an extent at which the ink is not ejected. By agitating the ink in the vicinity of the nozzle by micro-vibration driving, it is possible to maintain the ink in the vicinity of the nozzle at an appropriate viscosity.

However, in a case where micro-vibration driving is performed, since the thickened component in the vicinity of the nozzle is diffused inside the pressure chamber, it is necessary to also discharge the thickened component diffused not only in the vicinity of the nozzle but also up to the inside of the pressure chamber in order to restore the desired ejection characteristic with a flushing operation after performing the micro-vibration driving. That is, as a result of the micro-vibration driving, there is a problem in that the necessary ink ejection amount is increased in the flushing operation.

SUMMARY

An advantage of some aspects of the invention is that there is provided a liquid ejecting apparatus which includes a pressure chamber filled with liquid and a pressure generating element changing the pressure inside the pressure chamber and which ejects the liquid from the nozzle according to the change of pressure inside the pressure chamber. The liquid ejecting apparatus includes: a driving control unit that controls the pressure generating element and performs ejection driving for ejecting the liquid from the nozzle or micro-vibration driving for micro-vibrating the liquid surface inside the nozzle to an extent at which the liquid is not ejected from the nozzle; and a control unit that performs a flushing operation of an ejection amount according to the number of times of micro-vibration driving in the predetermined driving period, after the driving period has passed. In the above configuration, since the flushing operation is performed with an ejection amount according to the number of times of micro-vibration driving, it is possible to reduce the consumption amount of liquid in the flushing operation while maintaining the desired effect of the flushing operation.

It is preferable that the control unit includes: a micro-vibration counting unit that counts the number of times of micro-vibration driving in the driving period based on data specifying the content to control the pressure generating element; and an ejection amount determining unit that determines the ejection amount of the liquid in the flushing operation according to the number of times of micro-vibration driving in the driving period. According to the above aspect, there is an advantage in that the number of times of micro-vibration driving can be easily and reliably counted from the data specifying the content to control the pressure generating element.

In addition, the greater the number of times of micro-vibration driving in the driving period is, the greater the tendency for the thickened component in the vicinity of the nozzle to diffuse in a wide range inside the pressure chamber is. Taking the above tendency into consideration, a configuration increasing the ejection amount in the flushing operation as the number of times of micro-vibration driving in the driving period increases is preferable. Further, even in liquid ejection in the driving period, the thickened component inside the pressure chamber is discharged. Therefore, according to a configuration decreasing the ejection amount in the flushing operation as the number of times of ejection driving in the driving period increases, it is possible to reduce the consumption amount of liquid in the flushing operation.

It is preferable that the driving control unit stops the ejection driving and the micro-vibration driving in the driving period in which liquid is not ejected. According to the above aspect, in a case where liquid is not ejected even once in the driving period, since the needless diffusion of the thickened component inside the pressure chamber is suppressed, it is possible to reduce the ejection amount in the flushing operation. For example, the control unit can set the ejection amount in the flushing operation performed after the passing of the driving period in which liquid is not ejected to be less than the ejection amount of the flushing operation after the passing of the driving period in which micro-vibration driving is performed one or more times.

It is preferable that the driving control unit stops micro-vibration driving in the remaining period after the liquid ejection has finally been performed in the driving period. According to the above aspect, since the micro-vibration driving is stopped in the remaining period after the final liquid ejection, there is an advantage in that the needless diffusion of the thickened component inside the pressure chamber is suppressed. Further, a specific example of the above aspect will be described later as the second embodiment.

It is preferable that the liquid ejecting apparatus of an aspect of the invention be provided with a movement mechanism moving a liquid ejecting head having the pressure chamber, the pressure generating element, and the nozzle, between a first position and a second position. A typical example of the driving period is the period in which the liquid ejecting head moves from one of the first position or the second position to the other, or the period in which the liquid ejecting head reciprocates once between the first position and the second position. According to the above aspect, since a flushing operation is performed with the period in which the liquid ejecting head moves from one of the first position and the second position to the other, or the period in which the liquid ejecting head reciprocates between the first position and the second position set as the driving period, it is possible to effectively prevent the thickening of the liquid inside the pressure chamber.

The invention is also specified as a method of controlling the liquid ejecting apparatus according to each of the above aspects. The control method of the liquid ejecting apparatus according to the invention is for a liquid ejecting apparatus which includes a pressure chamber filled with liquid and a pressure generating element changing the pressure inside the pressure chamber and which ejects the liquid from the nozzle according to the change of pressure inside the pressure chamber. The control method controls the pressure generating element and performs ejection driving for ejecting the liquid from the nozzle or micro-vibration driving for micro-vibrating the liquid surface inside the nozzle to an extent at which the liquid is not ejected from the nozzle; and performs a flushing operation of an ejection amount according to the number of times of micro-vibration driving in the predetermined driving period, after the driving period has passed. The above control method also realizes a similar operation and effects to the liquid ejecting apparatus of the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

A: First Embodiment

Figure 1:
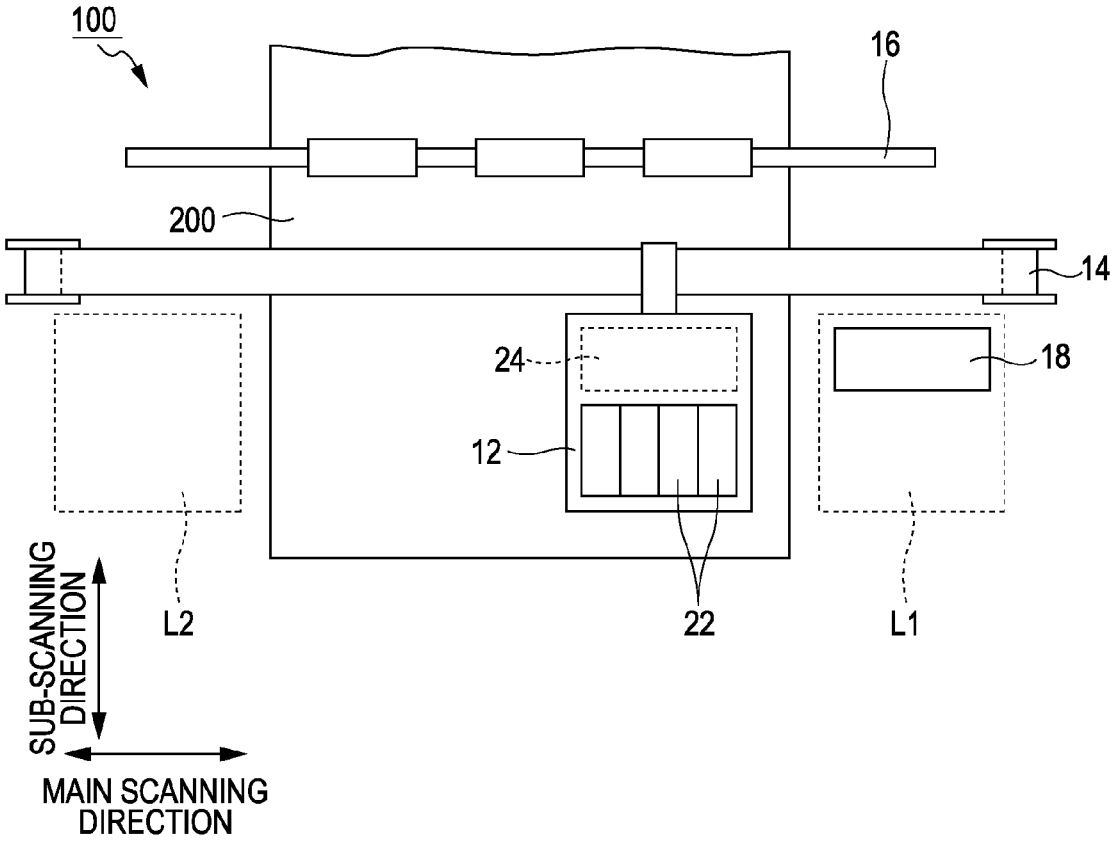
FIG. 1 is a partial schematic diagram of a printing apparatus according to the first embodiment of the invention.

FIG. 1 is a partial schematic diagram of an ink jet type printing apparatus 100 according to the first embodiment of the invention. The printing apparatus 100 is a liquid ejecting apparatus ejecting ink droplets onto recording paper 200, and is provided with a carriage 12, a movement mechanism 14 and a paper transporting mechanism 16.

The ink cartridge 22 and the recording head 24 are mounted on the carriage 12. The ink cartridge 22 is a vessel retaining ink (liquid) to be ejected to the recording paper 200. The recording head 24 functions as a liquid ejecting head ejecting ink retained in the ink cartridge 22 to the recording paper 200. Here, it is possible to employ a configuration fixing the ink cartridge 22 to the housing (not shown) of the printing apparatus 100 and supplying ink to the recording head 24.

Figure 2:
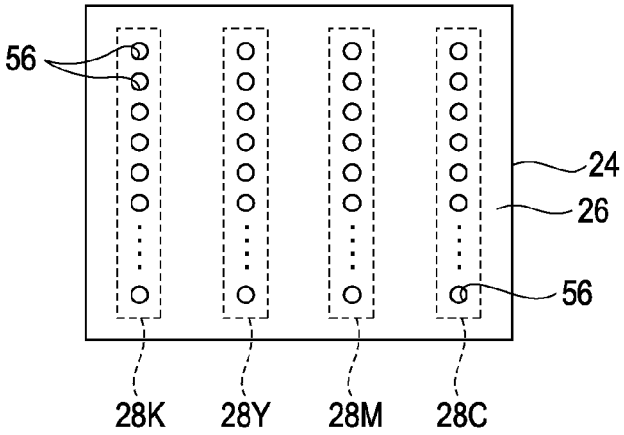
FIG. 2 is a plan diagram of a discharging surface of a recording head.

FIG. 2 is a plan diagram of a discharging surface 26 facing recording paper 200 in the recording head 24. As shown in FIG. 2, on the discharging surface 26 of the recording head 24, a plurality of nozzle rows 28 (28K, 28Y, 28M, and 28C) corresponding to different ink colors (black (K), yellow (Y), magenta (M), and cyan (C)) is formed. Each nozzle row 28 gathers N nozzles (discharge openings) 52 arranged in a straight line in a sub-scanning direction (N is a natural number). Black (K) ink is discharged from each nozzle 52 of the nozzle row 28K. Similarly, yellow (Y) ink is discharged from each nozzle 52 of the nozzle row 28Y, magenta (M) ink is discharged from each nozzle 52 of the nozzle row 28M, and cyan (C) ink is discharged from each nozzle 52 of the nozzle row 28C. In addition, a configuration in which each nozzle 52 is arranged in a staggered manner is preferable.

The movement mechanism 14 of FIG. 1 is made to reciprocate the carriage 12 in the main scanning direction (width direction of the recording paper 200) between the position L1 and the position L2. The position of the carriage 12 is detected by a detection unit (not shown) such as a linear encoder and used in the control of the movement mechanism 14. The position L1 and the position L2 are positions outside the range in which the discharge surface 26 faces the recording paper 200 (a position pinching the recording paper 200 in the main scanning direction when the recording paper 200 is viewed from the orthogonal direction). The position L1 corresponds to the standby position (home position) of the carriage 12 and a cap 18 is arranged at the position L1 so as to face the discharge surface 26 of the recording head 24. The cap 18 seals the discharge surface 26 of the recording head 24. A wiper (not shown) wiping the discharge surface 26 is arranged in the vicinity of the cap 18.

The paper transporting mechanism 16 of FIG. 1 moves the recording paper 200 in the sub-scanning direction alongside the reciprocation of the carriage 12. When the recording head 24 ejects ink onto the recording paper 200 during the reciprocation of the carriage 12, a desired image is recorded (printed) on the recording paper 200.

Figure 3A:
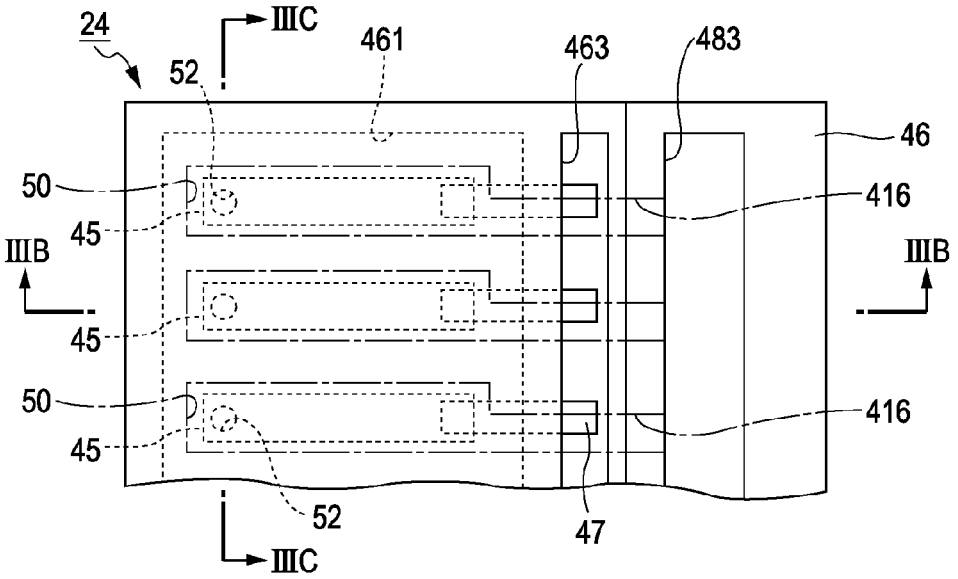
FIGS. 3A, 3B, and 3C are configurational diagrams of a recording head.
Figure 3B:
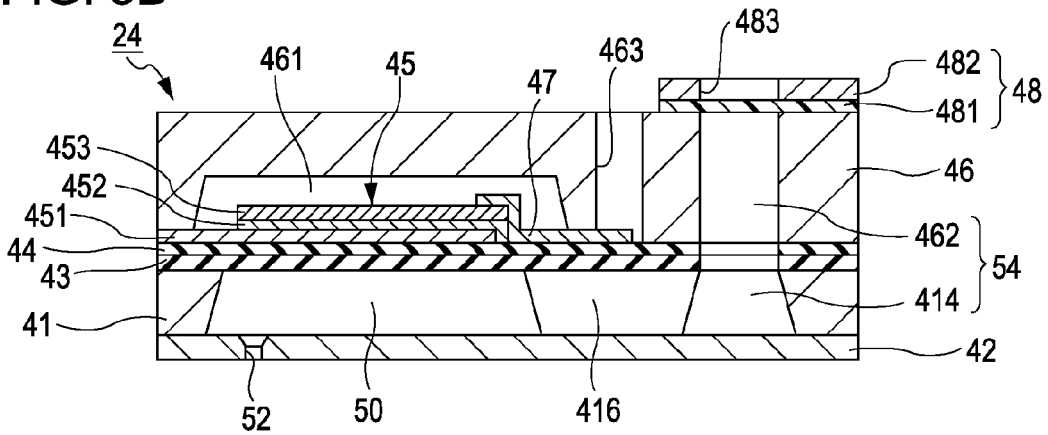
Figure 3C:
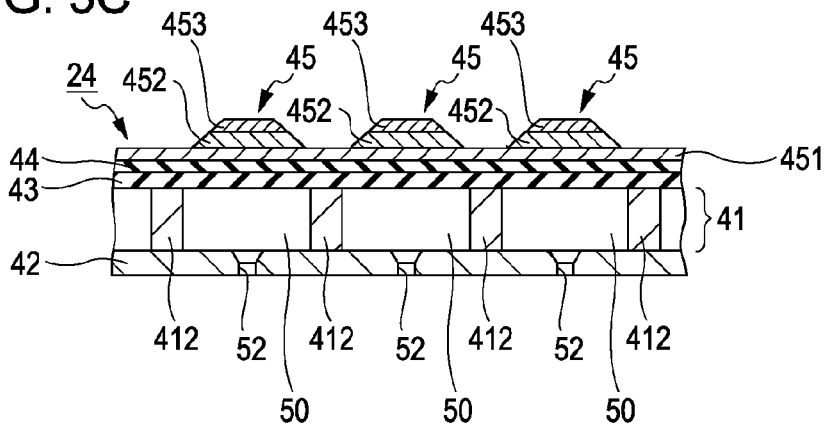

FIGS. 3A to 3C are configurational diagrams of the recording head 24 according to the first embodiment. Specifically, FIG. 3A is a plan diagram of the recording head 24, FIG. 3B is a cross-sectional diagram of the line IIIB-IIIB in FIG. 3A, and FIG. 3C is a cross-sectional diagram of the line IIIC-IIIC in FIG. 3A. As shown in FIGS. 3A to 3C, the recording head 24 has a structure in which a channel forming substrate 41, a nozzle forming substrate 42, an elastic film 43, an insulating film 44, a piezoelectric element 45, and a protective substrate 46 are stacked.

The channel forming substrate 41 is configured, for example, with a metal plate material of stainless steel or the like or a silicone monocrystal substrate or the like. As shown in FIGS. 3A and 3C, a plurality of long pressure chambers 50 are respectively established in parallel in the width direction (arrangement direction of the nozzles 52) in the channel forming substrate 41. Mutually adjoining pressure chambers 50 are divided by partitions 412. Further, a communication unit 414 is formed in an outside region of the longitudinal direction of each pressure chamber 50 in the channel forming substrate 41. The communication unit 414 and each pressure chamber 50 communicate with each other through an ink supply channel 416 formed at each pressure chamber 50. The ink supply channel 416 is formed with a narrower width than the pressure chamber 50 and provides a certain channel resistance with respect to the ink flowing into the pressure chamber 50 from the communication unit 414.

As shown in FIGS. 3B and 3C, a nozzle forming substrate 42 is fixed to the surface (opening surface) of the channel forming substrate 41 by an adhesive, a heat welded film, or the like, for example. On the nozzle forming substrate 42, a nozzle (through hole) 52, which communicates with the edge of the opposite side to the ink supply channel 416 in each pressure chamber 50, is formed. On the other hand, on the surface of the opposite side to the nozzle forming substrate 42 in the channel forming substrate 41, an elastic film 43 is formed of silicon dioxide ($SiO_2$), for example. On the surface of the elastic film 43, an insulating film 44 is formed of zirconium oxide ($ZrO_2$), for example, and on the surface of the insulating film 44, a piezoelectric element 45 is formed at each pressure chamber 50.

As shown in FIGS. 3B and 3C, the piezoelectric element 45 has a structure in which a lower electrode 451, a piezoelectric body 452, and an upper electrode 453 are stacked in this order from the insulating film 44 side. One of the lower electrode 451 and upper electrode 453 is a common electrode which is continuous across the plurality of pressure chambers 50 and the other of the lower electrode 451 and upper electrode 453 and the piezoelectric body 452 are formed (patterned) separately for each pressure chamber 50. Which of the lower electrode 451 and upper electrode 453 is set as the common electrode is appropriately determined, for example, according to the circumstances such as the polarization direction of the piezoelectric body 452 and the wiring. The upper electrode 453 on each piezoelectric element 45 is connected, for example, to a lead electrode 47 formed of gold (Au) or the like. When an electric field is provided between the lower electrode 451 and upper electrode 453 by the supply of the driving signal through the lead electrode 47, each piezoelectric element 45 and elastic film 43 is deformed (bending deformation).

As shown in FIG. 3B, a protective substrate 46 is fixed to the mounting surface of each piezoelectric element 45 in the channel forming substrate 41. In the region facing each piezoelectric element 45 in the protective substrate 46, a piezoelectric element holding unit 461 accommodating each piezoelectric element 45 is formed. The piezoelectric element holding unit 461 is formed with a size not inhibiting the displacement of each piezoelectric element 45 and protects each piezoelectric element 45. Further, in the region corresponding to the communication unit 414 of the channel forming substrate 41 in the protective substrate 46, a reservoir unit 462 is formed so as to penetrate the protective substrate 46. The reservoir unit 462 is a long space along the direction in which each of the pressure chambers 50 is arranged. The space made to communicate with the communication unit 414 of the channel forming substrate 41 and the reservoir unit 462 of the protective substrate 46 is configured as a reservoir 54 functioning as an ink chamber common to each pressure chamber 50.

In the region between the piezoelectric element holding unit 461 and the reservoir unit 462 in the protective substrate 46, through holes 463 penetrating the protective substrate 46 in the thickness direction are formed. The lower electrode 451 of the piezoelectric element 45 and the lead electrode 47 are exposed to the inner side of the through hole 463. On the surface of the protective substrate 46, a compliance substrate 48 in which a sealing film 481 and a fixing plate 482 are stacked is bonded. The sealing film 481 is configured of a flexible material having a low rigidity (polyphenylene sulfide film, for example) and seals the reservoir unit 462 of the protective substrate 46. The fixing plate 482 is configured of a hard material such as metal (for example, stainless steel). In a region facing the reservoir 54 (reservoir unit 462) in the fixing plate 482, an opening portion 483 is formed.

In the recording head 24 with the above configuration, ink supplied from the ink cartridge 22 is filled into the space reaching the nozzle 52 through each ink supply channel 416 from the reservoir 54 and each pressure chamber 50. When the piezoelectric element 45 and the elastic film 43 are deformed due to the supply of the driving signal, the pressure in the pressure chamber 50 is changed. By controlling the changing of the pressure in the pressure chamber 50 according to the driving signal, it is possible to perform an operation of ejecting the ink inside the pressure chamber 50 from the nozzle 52 (below, referred to as "ejection driving") or an operation of micro-vibrating the liquid surface (meniscus) of the ink in the nozzle 52 to an extent at which the ink in the pressure chamber 50 is not ejected (below, referred to as "micro-vibration driving").

Figure 4:
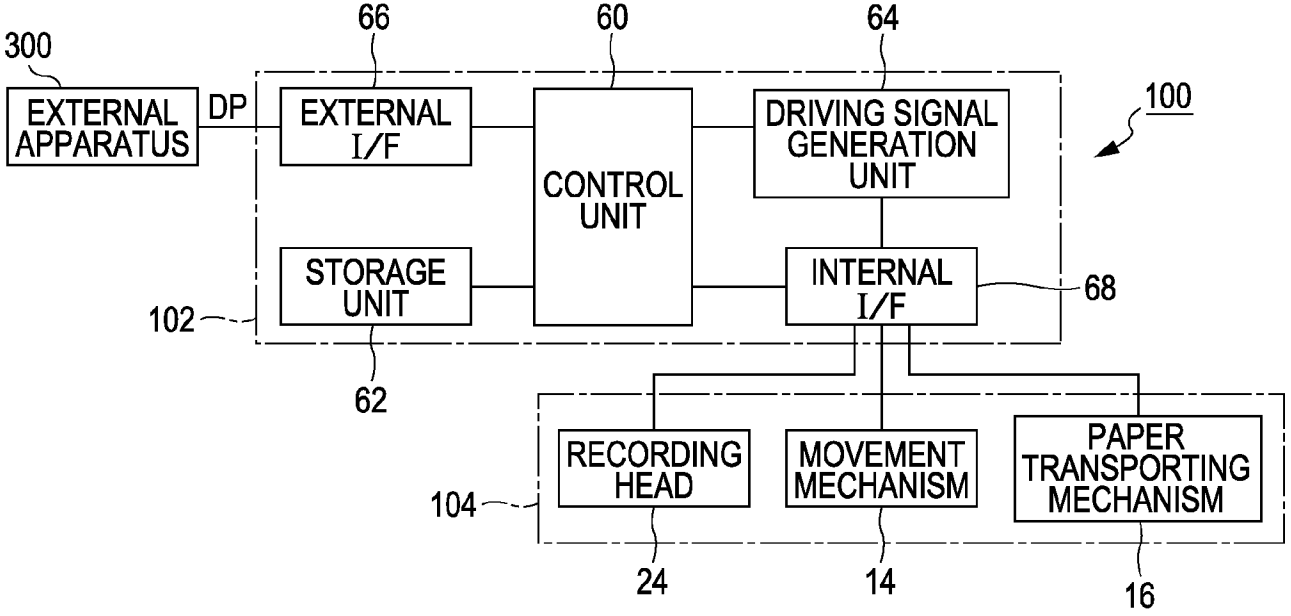
FIG. 4 is a block diagram of an electric configuration of a printing apparatus.

FIG. 4 is a block diagram of an electric configuration of a printing apparatus 100. As shown in FIG. 4, the printing apparatus 100 is provided with a control device 102 and a print processing unit (printing engine) 104. The control device 102 is an element controlling the entire printing apparatus 100 and includes a control unit 60, a storage unit 62, a driving signal generation unit 64, an external I/F (interface) 66, and an internal I/F 68. Print data DP showing an image to be printed on recording paper 200 is supplied to the external I/F 66 from an external apparatus (for example, a host computer) 300 and the print processing unit 104 is connected to the internal I/F 68. The print processing unit 104 is an element recording an image on recording paper 200 under the control of the control device 102 and includes the previously mentioned recording head 24, the movement mechanism 14 and the paper transporting mechanism 16.

Figure 5:
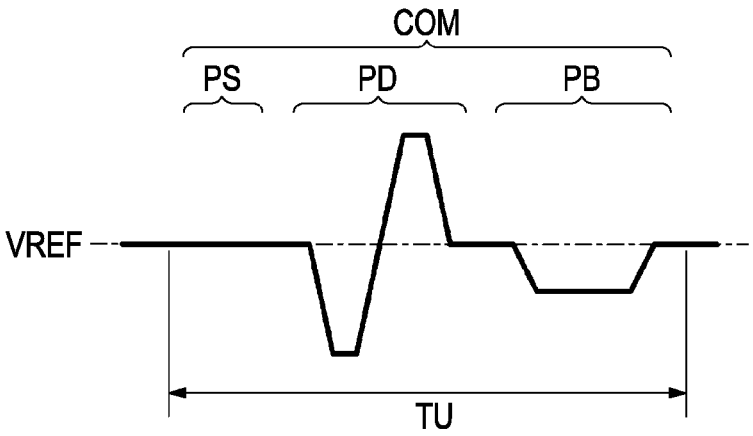
FIG. 5 is a waveform diagram of a driving signal.

The driving signal generation unit 64 generates a driving signal COM. The driving signal COM is a cyclic signal driving each piezoelectric element 45. As shown in FIG. 5, in a period TU (below, referred to as "printing cycle") corresponding to one cycle of the driving signal COM, the set potential element PS, the ejection pulse PD, and the micro-vibration pulse PB are arranged. When supplied to the piezoelectric element 45, the ejection pulse PD pressures the ink in the pressure chamber 50 by deforming the piezoelectric element 45 and the elastic film 43 so that a predetermined amount of ink is ejected from the nozzle 52. In addition, when supplied to the piezoelectric element 45, the micro-vibration pulse PB micro-vibrates (shakes) the meniscus in the nozzle 52 by changing the pressure in the pressure chamber 50 to an extent at which ink in the pressure chamber 50 is not ejected from the nozzle 52. Moreover, the set potential element PS is an interval maintained at a predetermined reference potential VREF. The piezoelectric element 45 stops being displaced and goes on standby according to the supply of the set potential element PS.

The storage unit 62 of FIG. 4 includes ROM storing control programs and the like and RAM temporarily storing various types of data used in image printing. The control unit 60 performs overall control of each element (for example, the print processing unit 104) of the printing apparatus 100 by executing the control program stored in the storage unit 62. Specifically, the control unit 60 generates control data DC indicating the operation of the piezoelectric element 45 in each printing cycle TU from the print data DP. The control data DC specify the ejection driving which ejects the ink in the pressure chamber 50 from the nozzle 52, the micro-vibration driving which micro-vibrates the meniscus of the ink in the nozzle 52, and the standby state which stops the displacement of the piezoelectric element 45 (that is, the state in which the ejection driving and the micro-vibration driving are not performed) as the operation of the piezoelectric element 45. The control data DC are repeatedly generated for each printing cycle TU.

Figure 6:
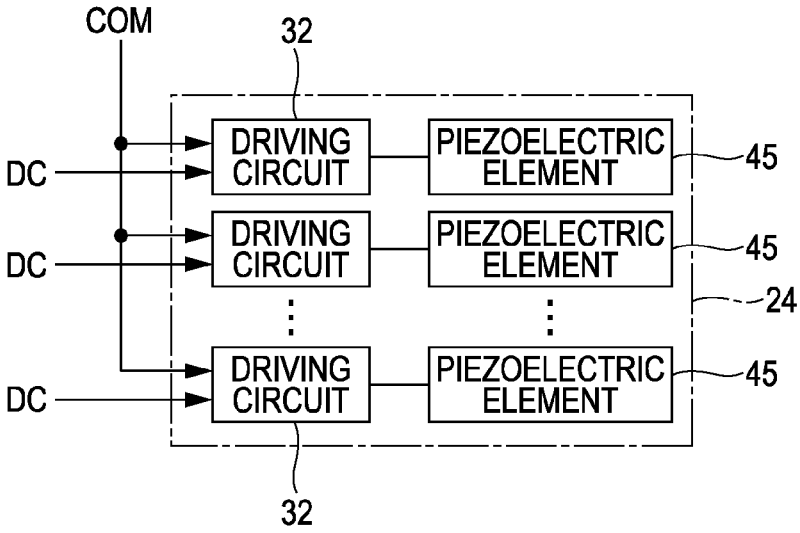
FIG. 6 is a block diagram of an electric configuration of a recording head.

FIG. 6 is a schematic diagram of an electric configuration of a recording head 24. As shown in FIG. 6, the recording head 24 includes a plurality of driving circuits 32 corresponding to separate piezoelectric elements 45. The driving signal COM generated by the driving signal generation unit 64 is supplied in common to a plurality of driving circuits 32 via the internal I/F 68. Further, the control data DC generated by the control unit 60 are supplied to each driving circuit 32 via the internal I/F 68.

Each driving circuit 32 selects an interval, which corresponds to the control data DC supplied from the control unit 60, from the driving signal COM and supplies the interval to the piezoelectric element 45. Specifically, when the control data DC indicate ejection driving, the driving circuit 32 selects an ejection pulse PD of the driving signal COM and supplies the ejection pulse to the piezoelectric element 45. Thus, ink in the pressure chamber 50 is ejected from the nozzle 52 onto the recording paper 200 (ejection driving). On the other hand, when the control data DC indicate micro-vibration driving, the driving circuit 32 selects the micro-vibration pulse PB of the driving signal COM and supplies the micro-vibration pulse to the piezoelectric element 45. Thus, micro-vibration is applied to the meniscus in the nozzle 52 and the ink in the pressure chamber 50 is appropriately agitated without being ejected (micro-vibration driving). Further, when the control data DC indicate the standby state, the driving circuit 32 selects the set potential element PS of the driving signal COM and supplies the set potential element to the piezoelectric element 45. When the set potential element PS is supplied, since the piezoelectric element 45 stands by without performing ejection driving or micro-vibration driving, the ink in the pressure chamber 50 is not agitated.

Figure 7:
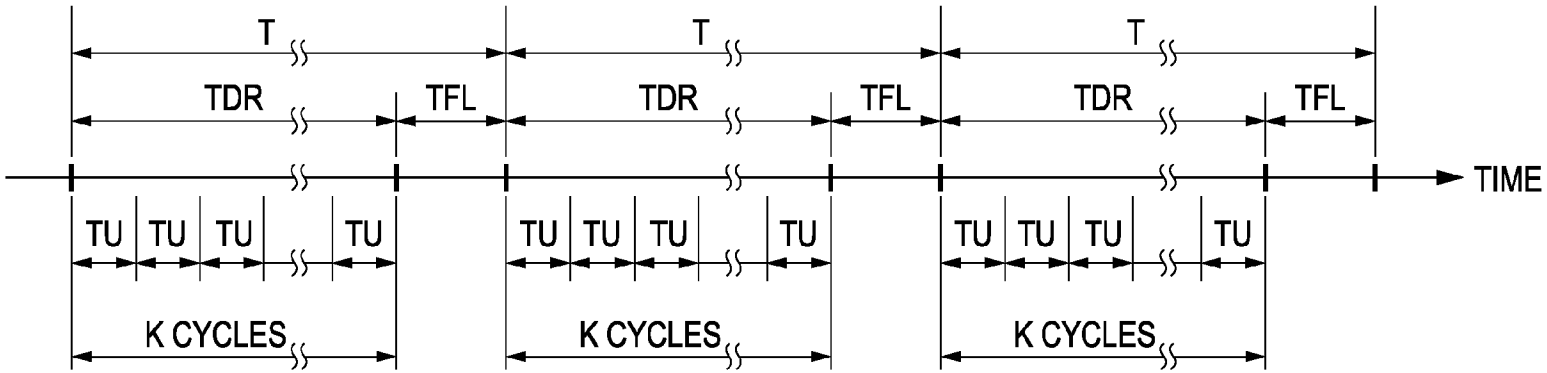
FIG. 7 is an explanatory diagram of a driving period and a preparation period.

As shown in FIG. 7, the operation period of the printing apparatus 100 is divided into a plurality of periods T. Each of the plurality of periods T includes a driving period TDR and a preparation period TFL. In the driving period TDR, an image is formed on the recording paper 200 by ejecting ink from each nozzle 52. For example, a period in which the carriage 12 reciprocates once between the position L1 and the position L2 in parallel with the ejection of ink by the recording head 24 (two raster periods) is defined as the driving period TDR. Each driving period TDR is configured by K printing cycles TU. One printing cycle TU corresponds to the time for forming one dot on the surface of the recording paper 200. In the driving period TDR, control data DC of each piezoelectric element 45 are generated for each of the K printing cycles TU.

Figure 8:
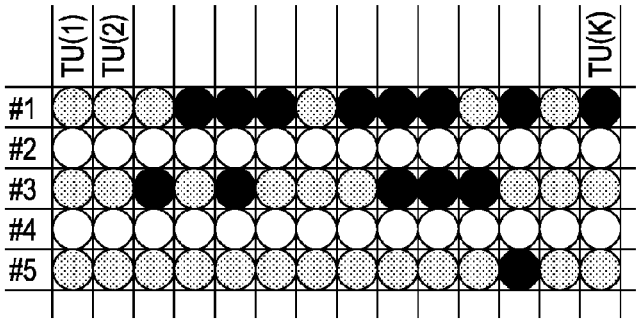
FIG. 8 is an explanatory diagram of an operation generating control data.

FIG. 8 is a schematic diagram showing the content of control data DC generated for each of K printing cycles TU in the driving period TDR (reference signs TU(1) to TU(K) of FIG. 8) for N (illustrated as 5 nozzles for convenience in FIG. 8) nozzles 52 (piezoelectric elements 45). The black circles of FIG. 8 signify control data DC indicating ejection driving, the hatched circles signify control data DC indicating micro-vibration driving, and the white circles signify control data DC indicating a standby state (a state in which neither ejection driving nor micro-vibration driving are performed).

As with No. 1 (#1), No. 3 (#3), and No. 5 (#5) of the nozzles 52 in FIG. 8, with regard to the nozzles 52 determined from the print data DP when at least one ink ejection is to be performed in the driving period TDR, the control unit 60 generates control data DC indicating ejection driving with respect to each of Nt printing cycles TU for which ink ejection is to be performed, and generates control data DC indicating micro-vibration driving with respect to each of Nb (Nb=K−Nt) printing cycles TU remaining in the driving period TDR. That is, the control unit 60 functions as an element (driving control unit) sequentially performing ejection driving or micro-vibration driving at the piezoelectric element 45 for each printing cycle TU in the driving period TDR.

Meanwhile, as with No. 2 (#2), and No. 4 (#4) of the nozzles 52 in FIG. 8, with regard to the nozzles 52 determined from the print data DP when ink ejection is not to be performed even one time in the driving period TDR, the control unit 60 generates control data DC indicating the standby state with respect to each of the printing cycles TU of the whole driving period TDR (K cycles). That is, regarding the nozzles 52 for which ink ejection is not to be performed even one time in the driving period TDR, ejection driving and micro-vibration driving are not performed in the driving period TDR. As may be understood from the above description, the control unit 60 of the first embodiment functions as an element (driving control unit) which places the piezoelectric element 45 on standby without performing ejection driving or micro-vibration driving in each printing cycle TU in the driving period TDR in which ink ejection from the nozzles 52 is not performed.

The preparation period TFL of FIG. 7 is positioned between successive driving periods TDR and is a period in which the recording head 24 performs the flushing operation. The flushing operation forcibly ejects ink from each nozzle 52 in a state in which the recording head 24 is moved to the position L1 of FIG. 1 (on cap 18). Ink ejected from each nozzle 52 in the flushing operation is received in the cap 18. By periodically performing the flushing operation in the above manner, the clogging of each nozzle 52 and the introduction of bubbles into the pressure chamber 50 is eliminated. The control unit 60 functions as an element (described below as a flushing control unit 76) performing the flushing operation by supplying control data DC indicating the ejection driving in each piezoelectric element 45 to the recording head 24 in the preparation period TFL.

Figure 9:
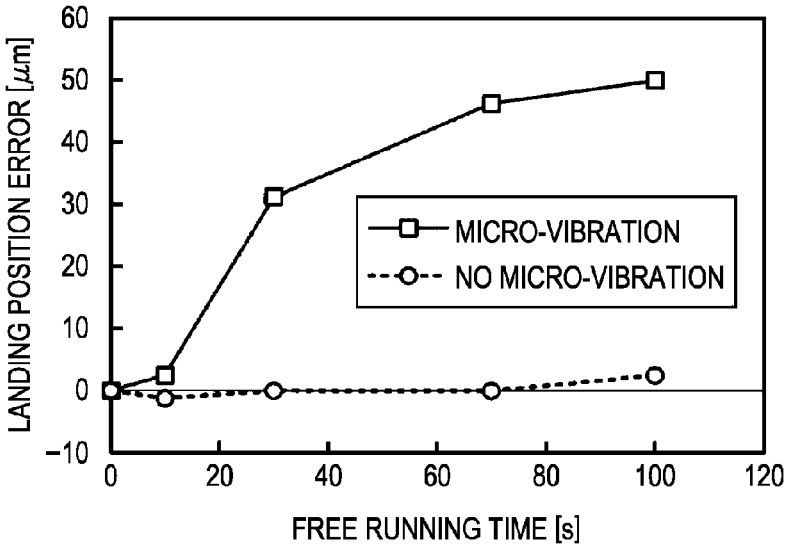
FIG. 9 is a graph showing a relationship between free running time and landing position error.

FIG. 9 is a graph showing experiment results of a relationship between the time for which the recording head 24 runs freely (free running time) and landing position error while the flushing operation is periodically performed. The free running time displayed by the horizontal axis of FIG. 9 signifies the length of time in which the carriage 12 is moved while performing a flushing operation of a minute amount at predetermined times (every 2.81 seconds). The landing position error displayed by the vertical axis of FIG. 9 signifies the distance (deviation amount) between the actual position at which the ink ejected from the nozzles 52 after the free running time has landed and the target position. The characteristics of a case where the micro-vibration driving is performed cyclically at the piezoelectric element 45 in the free running time (solid line), and the characteristics of a case where the micro-vibration driving is not performed at the piezoelectric element 45 in the free running time (broken line) are shown together.

Ink in the pressure chamber 50 is locally thickened due to the evaporation of moisture from the surface (meniscus) exposed to the inside of the nozzle 52, the aggregation of components, and the like. Therefore, to appropriately eject ink in the pressure chamber 50 from the nozzle 52 with the target ejection characteristics (ejection amount and ejection speed), it is important to prevent thickening of the ink (meniscus) in the vicinity of the nozzle 52 and maintain an appropriate viscosity by agitating the ink moderately using the micro-vibration driving.

However, in a case where micro-vibration driving is performed at the piezoelectric element 45 and the meniscus is made to micro-vibrate, it may be understood from FIG. 9 that, in comparison with a case where micro-vibration driving is not performed, there is a tendency for the landing position error to increase regardless of whether the flushing operation is performed at predetermined cycles. The reason for the observation of the above tendency is considered to be because the thickened component inside the pressure chamber 50 is not sufficiently discharged by the flushing operation. In other words, thickening in the vicinity of the meniscus is reliably prevented by the micro-vibration driving; however, since the thickened component in the vicinity of the nozzle 52 is diffused in a wide range in the pressure chamber 50, the thickened component diffused inside the pressure chamber 50 is not sufficiently discharged simply by discharging a minute amount of ink in a typical flushing operation, and the ejection characteristics of the recording head 24 are not completely restored. That is, in a case where micro-vibration driving is not performed, since the thickened component is only accumulated in the vicinity of the nozzle 52, even in the case of ejecting a minute amount of ink with the flushing operation, the thickened component is effectively removed and the ejection characteristics are restored. However, in a case where the micro-vibration driving is performed, since the thickened component is diffused in a wide range inside the pressure chamber 50, when only a minute amount of ink is discharged by the flushing operation, the thickened component is not sufficiently discharged and the amount of ink to be ejected in order to sufficiently restore the ejection characteristics becomes large. Here, the above tendency becomes more apparent the longer the free running time becomes and the greater the number of times of micro-vibration becomes.

Figure 10:
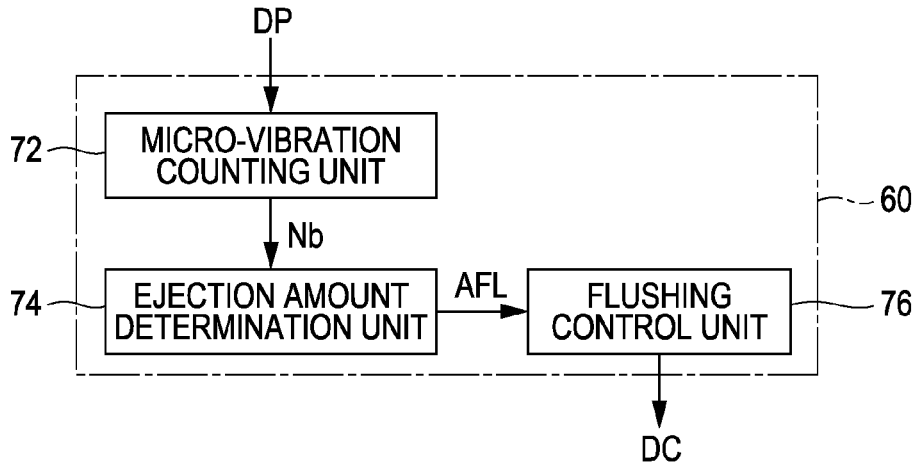
FIG. 10 is a block diagram of functions controlling the flushing operation in the control unit.

Taking this tendency into consideration, the ink ejection amount AFL according to the flushing operation in the preparation period TFL is variably controlled by the control unit 60 in accordance with the number of times of micro-vibration driving Nb (number of printing cycles TU) performed by the piezoelectric element 45 in the immediately previous driving period TDR. FIG. 10 is a block diagram of the function of controlling the ejection amount AFL with the flushing operation in the control unit 60. As shown in FIG. 10, the control unit 60 functions as a micro-vibration counting unit 72, an ejection amount determining unit 74 and a flushing control unit 76. Each element of FIG. 10 is realized by executing a control program stored in the storage unit 62.

The micro-vibration counting unit 72 counts the total number of times Nb that the micro-vibration driving is performed for each nozzle 52 in each driving period TDR (that is, in successive flushing operation intervals) by analyzing the print data DP supplied from an external device 300. The ejection amount determining unit 74 determines the ink ejection amount AFL in the immediately following flushing operation for each nozzle 52 according to the number of times Nb counted by the micro-vibration counting unit 72. The flushing control unit 76 controls each piezoelectric element 45 and performs the flushing operation of the ejection amount AFL determined by the ejection amount determining unit 74. For example, the flushing control unit 76 determines the driving conditions for ejecting the ink of the ejection amount AFL (for example, the number of ejections and the amount ejected at one time), and controls the piezoelectric element 45 based on these driving conditions.

Figure 11:
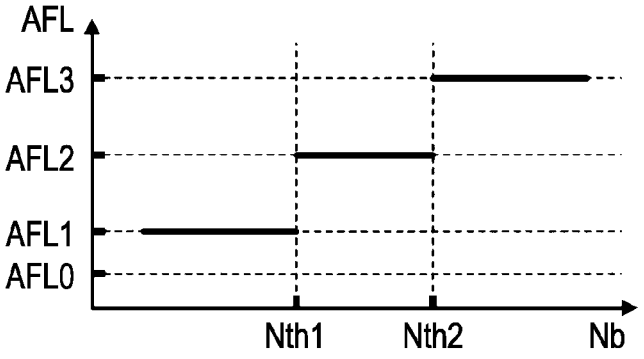
FIG. 11 is a graph showing the relationship between the number of times of micro-vibration driving and the ejection amount in the flushing operation.

Specifically, as shown in FIG. 11, the ejection amount determining unit 74 determines the ejection amount AFL for each nozzle 52 so that, as the number of times of micro-vibration driving Nb counted by the micro-vibration counting unit 72 in the driving period TDR increases (that is, the more the thickened component diffuses in a wide range inside the pressure chamber 50), the ejection amount AFL according to the flushing operation of the preparation period TFL increases, and the flushing control unit 76 performs the flushing operation discharging ink of the ejection amount AFL at each piezoelectric element 45. However, in the first embodiment, since the total value of the number of micro-vibration drivings Nb in the driving period TDR and the number of times of ejection driving Nt is the total K of the printing cycles TU in the driving period TDR, it may also be said that each piezoelectric element 45 is controlled such that the ejection amount AFL according to the flushing operation in the preparation period TFL becomes smaller as the number of times of ejection driving Nt in the driving period TDR becomes greater (as the thickened component inside the pressure chamber 50 is ejected). Here, the method by which the ejection amount determining unit 74 of the control unit 60 determines the ejection amount AFL according to the number of times Nb and the number of times Nt is arbitrary; however, a configuration of finding the ejection amount AFL according to the actual number of times Nb from a table in which each numerical value of the number of times Nb (or the number of times Nt) is made to correspond to each numerical value of the actual ejection amount AFL, or a configuration in which the ejection amount AFL is calculated by the operation of a predetermined formula defining the relationship between the number of times Nb and the ejection amount AFL.

In the example of FIG. 8, regarding the third nozzle 52 in which the number of times Nb of micro-vibration driving in the driving period TDR is at a medium level (between the threshold value Nth1 and the threshold value Nth2 of FIG. 11), the flushing operation of the ejection amount AFL2 in the preparation period TFL is instructed. On the other hand, regarding the first nozzle 52 in which the number of times Nb of micro-vibration driving inside the driving period TDR is less than the threshold value Nth1 of FIG. 11 (the number of times Nt of ejection driving is great), the flushing operation of the ejection amount AFL1 which is smaller than the ejection amount AFL2 (AFL1<AFL2) is instructed. Regarding the fifth nozzle 52 in which the number of times Nb of micro-vibration driving inside the driving period TDR is greater than the threshold value Nth2 of FIG. 11 (the number of times Nt of ejection driving is low), the flushing operation of the ejection amount AFL3 which is greater than the ejection amount AFL2 (AFL3>AFL2) is instructed. Further, regarding the nozzle 52 for which the standby state is instructed in the driving period TDR (that is, a nozzle 52 for which ink is not ejected even one time), the flushing operation of a predetermined ejection amount AFL0 which is further lower than the minimum value (ejection amount AFL1) of the ejection amount AFL of the nozzle 52 in which the micro-vibration driving is performed in the driving period TDR (AFL0<AFL1) is instructed.

In the first embodiment described above, the ejection amount AFL according to the flushing operation is variably controlled according to the number of times Nb of micro-vibration driving in the driving period TDR (that is, the extent to which the thickened component is diffused). In other words, the ejection amount AFL in the flushing operation is variably controlled according to the number of times Nt of ejection driving in the driving period TDR (that is, the extent of the discharge of the thickened component). In this manner, for example, it is possible to reduce the consumption amount of ink according to the flushing operation in comparison with a configuration where each piezoelectric element 45 performs the flushing operation of the ejection amount AFL3 regardless of the number of times Nb of micro-vibration driving or the number of times Nt of ejection driving. Further, for example, it is possible to sufficiently discharge the thickened component diffused in the pressure chamber 50 by micro-vibration in comparison to a configuration where each piezoelectric element 45 performs a flushing operation of the ejection amount AFL1 regardless of the number of times Nb of micro-vibration driving or the number of times Nt of ejection driving. That is, according to the first embodiment, there is an advantage in that it is possible to reduce the consumption amount of ink used in the flushing operation while sufficiently maintaining the expected effect of the flushing operation (eliminating the clogging of the nozzle 52 and introduction of bubble into the pressure chamber 50).

B: Second Embodiment

Figure 12:
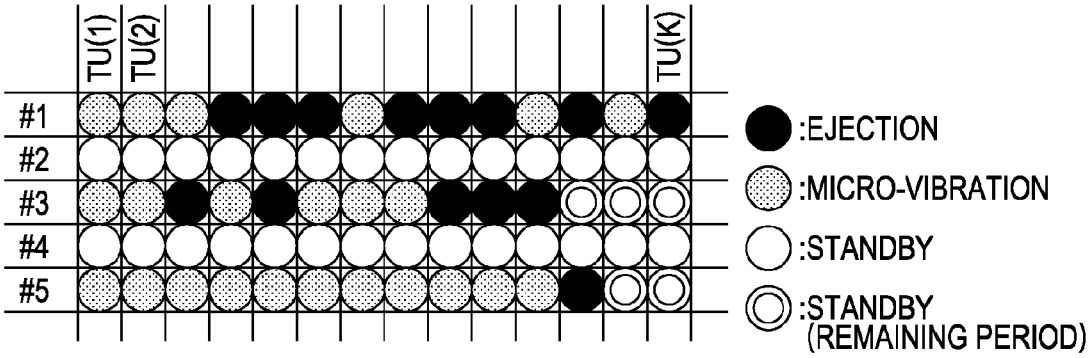
FIG. 12 is an explanatory diagram of an operation in which a control unit of a second embodiment generates control data.

FIG. 12 is a schematic diagram illustrating the content of the control data DC generated for each printing cycle TU with respect to each nozzle 52 with the same method as FIG. 8 above. In the first embodiment in which the piezoelectric element 45 performs ejection driving and micro-vibration driving alternatively with respect to the nozzles 52 for which the ink ejection in the driving period TDR is to be performed, the micro-vibration driving is performed even in one or more printing cycles (below, called the "remaining period") after the printing cycle TU in which ink is finally ejected in the driving period TDR has passed. However, since the micro-vibration is an operation with the object of handling ink ejection, micro-vibration driving may be not performed in the remaining period in which ink is not to be ejected. Thus, as illustrated by the double circles regarding the third and fifth nozzles 52 of FIG. 12, the control unit 60 of the second embodiment generates control data DC instructing the standby state with respect to each printing cycle TU (remaining period) after the printing cycle TU in which ink is finally ejected in the driving period TDR has passed. That is, in the remaining period from the final ejection of the ink until the end of the driving period TDR in the driving period TDR, neither ejection driving nor micro-vibration driving are performed in any of the piezoelectric elements 45.

In the second embodiment described above, regarding the nozzle 52 for which ink ejection finishes partway through the driving period TDR, since the number of times Nb of micro-vibration driving is reduced only to the extent of the number of printing cycles TU in the remaining period, it is possible to further reduce the ejection amount AFL in the flushing operation in the immediately following preparation period TFL in comparison with the first embodiment. Accordingly, in addition to the same effect as the first embodiment, it is possible to further reduce the consumption amount of ink in the flushing operation. Further, in the remaining period, since the supply of the micro-vibration pulse PB with respect to the piezoelectric elements 45 (vibration of the piezoelectric elements 45) is stopped, there is an advantage in that, along with the reduction of the electric power consumption, it is possible to suppress the deterioration of the piezoelectric elements 45 in comparison with a configuration in which micro-vibration is provided even in the remaining period.

C: Modifications

Each of the above forms may be variously modified. Specific modified aspects will be exemplified below. It is possible to appropriately combine two or more of the aspects arbitrarily selected from the examples below.

1. Modification 1

Figure 13:
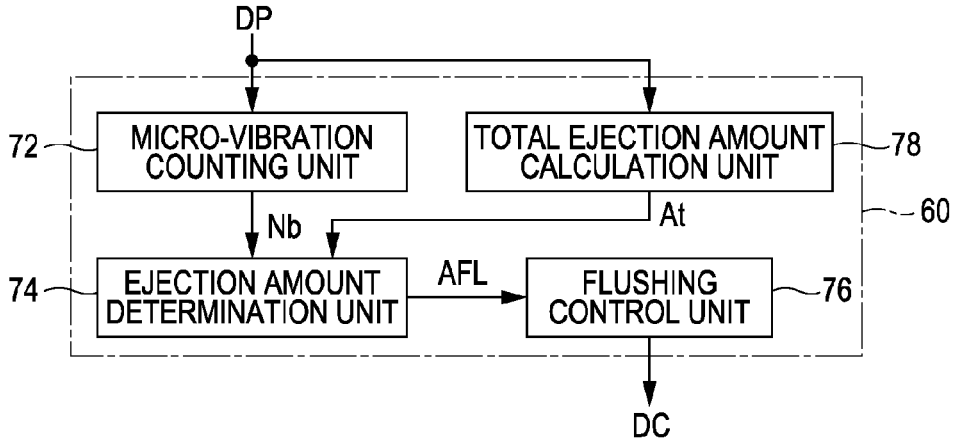
FIG. 13 is a block diagram of functions controlling a flushing operation in the control unit in a modification.

In each from above, the ejection amount AFL of ink in the flushing operation is determined according to the number of times Nb of micro-vibration driving and number of times Nt of ejection driving in the driving period TDR; however, it is also possible to reflect the total ink ejection amount At in the driving period TDR (below, called the "total ejection amount") in the ejection amount AFL. FIG. 13 is a block diagram of a function controlling the ejection amount AFL of the flushing operation in the control unit 60 in modification 1. As shown in FIG. 13, the control unit 60 of modification 1 functions as a total ejection amount calculation unit 78 as well as the same elements as the above-described forms (micro-vibration counting unit 72, ejection amount determining unit 74, flushing control unit 76).

The total ejection amount calculation unit 78 calculates the total ejection amount At of ink in each driving period TDR for each nozzle 52 by analyzing the print data DP. Specifically, the total ejection amount calculation unit 78 calculates the total ejection amount At according to the number of times Nt of ejection driving in the driving period TDR and the ink ejection amount for each time. For example, when the recording head 24 forms a plurality of dots of different sizes (for example, large dots, medium dots, and small dots) on the recording paper 200, the total ejection amount calculation unit 78 counts the number of ink ejections for each kind of dot, and calculates the total ejection amount At from each counted value and the ink ejection amount of each dot.

The ejection amount determining unit 74 determines the ejection amount AFL of the flushing operation for each nozzle 52 according to the number of times Nb of micro-vibration driving counted by the micro-vibration counting unit 72 and the total ejection amount At calculated by the total ejection amount calculation unit 78. Specifically, the ejection amount determining unit 74 determines the ejection amount AFL according to the number of times Nb of micro-vibration driving similarly to each form described above and moreover determines the ejection amount AFL so that the ejection amount AFL used in the flushing operation is reduced as the total ejection amount At is increased. According to the above configuration, since the total ejection amount At in the driving period TDR is reflected in the ejection amount AFL in addition to the number of times Nb of micro-vibration driving, there is an advantage in that it is possible to appropriately determine the ejection amount AFL in comparison with each form described above.

2. Modification 2

The length of time of the driving period TDR (interval of the flushing operation) is arbitrary. For example, in a configuration in which it is possible to perform the flushing operation at both position L1 and position L2 (for example, a configuration in which the cap 18 is installed at both the position L1 and the position L2), the period in which the carriage 12 moves from one side of position L1 and position L2 to the other side (1 raster period) is set as the driving period TDR. Further, it is possible to set the period in which the carriage 12 reciprocates between position L1 and position L2 a plurality of times as the driving period TDR.

3. Modification 3

The method of performing the flushing operation at each piezoelectric element 45 and the method of changing the ejection amount AFL are arbitrary. For example, in each form described above, the driving signal COM performing ejection driving at each piezoelectric element 45 in the driving period TDR is also diverted to the flushing operation in the preparation period TFL; however, it is also possible to generate a dedicated driving signal performing a flushing operation at each piezoelectric element 45. Further, in each form described above, the ejection amount AFL is changed by controlling the number of ink ejections; however, for example, it is also possible to change the ejection amount AFL used in the flushing operation by controlling the ejection amount of a single time (the amplitude of the vibration provided to the pressure chamber 50).

4. Modification 4

In each form described above, the ejection amount AFL in the flushing operation in the whole range of the number of times Nb of micro-vibration driving in the driving period TDR is changed in stages (AFL1, AFL2, and AFL3); however, the relationship of the number of times Nb or the number of times Nt and the ejection amount AFL is arbitrary. For example, it is possible to employ a configuration in which the ejection amount AFL is set so as to change linearly with respect to the number of times Nb or the number of times Nt, or a configuration in which the ejection amount AFL is defined as a predetermined function of the number of times Nb or the number of times Nt.

5. Modification 5

In each form described above, a driving signal COM of one system is supplied to the recording head 24; however, it is possible to employ a configuration in which driving signals of a plurality of systems are used to drive the piezoelectric elements 45 (for example, a configuration in which a separate driving signal is set for the ejection pulse PD and the micro-vibration pulse PB). Further, in each form described above, ink is only ejected once in one printing cycle TU; however, it is possible to perform ink ejection a plurality of times in one printing cycle TU. Further, the waveform of each pulse (PD, PB) of the driving signal is arbitrary.

6. Modification 6

In each form described above, a serial type printing apparatus 100 moving a carriage 12 mounted with a recording head 24 was exemplified; however, it is also possible to apply the invention to a line type printing apparatus 100 in which a plurality of nozzles 52 are arranged so as to face the entire region in the width direction of the recording paper 200. In the line type printing apparatus 100, the recording head 24 is fixed, and an image is recorded on the recording paper 200 by ejecting ink droplets from each nozzle 52 while transporting the recording paper 200. As will be understood from the above description, it does not matter whether the recording head 24 itself is movable or fixed in the invention.

7. Modification 7

The configuration of the element (pressure generating element) changing the pressure in the pressure chamber 50 is not limited to the above examples. For example, it is also possible to use a vibrator such as an electrostatic actuator. Further, the pressure generating element of the invention is not limited to an element providing mechanical vibration to the pressure chamber 50. For example, it is also possible to use a heat generating element (heater), which changes the pressure inside the pressure chamber 50 by generating bubbles by heating the pressure chamber 50, as the pressure generating element. That is, the pressure generating element of the invention includes all elements changing the pressure in the pressure chamber 50, and the method of changing the pressure (piezo type/thermal type) and the configuration do not matter.

8. Modification 8

The printing apparatus 100 of each of the above forms may be employed as various types of devices such as a plotter, a facsimile machine, and a copier. However, the purpose of the liquid ejecting apparatus of the invention is not limited to image printing. For example, a liquid ejecting apparatus ejecting a solution of various color materials may be used as a manufacturing apparatus forming a color filter for a liquid crystal display apparatus. Further, a liquid ejecting apparatus ejecting a liquid state conductive material may be used as an electrode manufacturing apparatus forming electrodes of a display apparatus such as an organic EL (Electroluminescence) display apparatus and a FED display apparatus (FED: Field Emission Display). Further, a liquid ejecting apparatus ejecting a solution of a bio-organic substance may be used as a chip manufacturing apparatus manufacturing biochemical elements (biochips).

The entire disclosure of Japanese Patent Application No. 2011-017634, filed Jan. 31, 2011 is expressly incorporated by reference herein.

What is claimed is:

1. A liquid ejecting apparatus which includes a pressure chamber filled with liquid and a pressure generating element changing pressure inside the pressure chamber and ejects the liquid from a nozzle according to the change of pressure inside the pressure chamber, the apparatus comprising:

a driving control unit that controls the pressure generating element and performs ejection driving for ejecting the liquid from the nozzle or micro-vibration driving for micro-vibrating the liquid surface inside the nozzle to an extent at which the liquid is not ejected from the nozzle; and a control unit that performs a flushing operation of an ejection amount after a predetermined driving period has passed, wherein the ejection amount is determined based on a number of times the micro-vibration driving is performed by the driving control unit within the predetermined driving period that has passed, wherein the driving control unit stops the ejection driving and the micro-vibration driving in a driving period in which the liquid is not ejected, and the control unit sets the ejection amount in the flushing operation performed after passing of the driving period in which the liquid is not ejected to be less than an ejection amount in the flushing operation after passing of a driving period in which micro-vibration driving is performed one or more times.

2. The liquid ejecting apparatus according to claim 1, wherein the control unit includes:

a micro-vibration counting unit that counts the number of times the micro-vibration driving is performed in the driving period based on data specifying content to control the pressure generating element; and an ejection amount determining unit that determines the ejection amount of the liquid in the flushing operation according to the number of times the micro-vibration driving is performed in the driving period.

3. The liquid ejecting apparatus according to claim 1 wherein the control unit increases the ejection amount in the flushing operation as the number of times the micro-vibration driving in the driving period increases.

4. The liquid ejecting apparatus according to claim 1 wherein the control unit reduces the ejection amount in the flushing operation as a number of times the ejection driving in the driving period increases.

5. The liquid ejecting apparatus according to claim 1 wherein the driving control unit stops the micro-vibration driving in a remaining period after the liquid ejection is finally performed in the driving period.

6. The liquid ejecting apparatus according to claim 1, further comprising:

a movement mechanism moving a liquid ejecting head having the pressure chamber, the pressure generating element, and the nozzle, between a first position and a second position.

7. The liquid ejecting apparatus according to claim 6, wherein the driving period is a period in which the liquid ejecting head moves from one of the first position and the second position to the other, or a period in which the liquid ejecting head reciprocates once between the first position and the second position.

8. A control method of a liquid ejecting apparatus which includes a pressure chamber filled with liquid and a pressure generating element changing pressure inside the pressure chamber and ejects the liquid from a nozzle according to the change of pressure inside the pressure chamber, the method comprising:

controlling the pressure generating element and performing ejection driving for ejecting the liquid from the nozzle or micro-vibration driving for micro-vibrating a liquid surface inside the nozzle to an extent at which the liquid is not ejected from the nozzle;

performing a flushing operation of an ejection amount according after a predetermined driving period has passed, wherein the ejection amount is determined based on a number of times the micro-vibration driving is performed in the predetermined driving period that has passed;

stopping the ejection driving and the micro-vibration driving in a driving period in which the liquid is not ejected; and setting the ejection amount in the flushing operation performed after passing of the driving period in which the liquid is not ejected to be less than an ejection amount in the flushing operation after passing of a driving period in which micro-vibration driving is performed one or more times.

* * * * *